US008746093B2

(12) United States Patent
Wang et al.

(10) Patent No.: US 8,746,093 B2
(45) Date of Patent: Jun. 10, 2014

(54) OIL PUMPING UNIT

(75) Inventors: Minxuan Wang, Dongying (CN); Jianli Xu, Dongying (CN); Zhengquan Cheng, Dongying (CN); Bin Wei, Dongying (CN); Zhonghui Zhang, Dongying (CN); Bingsheng Liu, Dongying (CN); Guangqi Gao, Dongying (CN); Yan Luo, Dongying (CN); Zejun Zhu, Dongying (CN)

(73) Assignees: China Petroleum & Chemical Corporation, Beijing (CN); Oil Production Technology Research Institute of Shengli Oilfield Branch of China Petroleum Chemical Corporation, Dongying (CN)

( * ) Notice: Subject to any disclaimer, the term of this patent is extended or adjusted under 35 U.S.C. 154(b) by 440 days.

(21) Appl. No.: 13/171,495

(22) Filed: Jun. 29, 2011

(65) Prior Publication Data

US 2011/0318199 A1 Dec. 29, 2011

(30) Foreign Application Priority Data

Jun. 29, 2010 (CN) ..... 2010 1 0226167

(51) Int. Cl.
*F16H 21/32* (2006.01)
*F16H 21/44* (2006.01)
*F04B 17/00* (2006.01)

(52) U.S. Cl.
USPC ..... 74/41; 74/40; 74/108; 417/415

(58) Field of Classification Search
USPC ..... 417/254, 313, 415, 904; 74/41, 40, 108
See application file for complete search history.

(56) References Cited

U.S. PATENT DOCUMENTS

| | | | | | |
|---|---|---|---|---|---|
| 420,692 | A | * | 2/1890 | Miller | 173/88 |
| 1,556,862 | A | * | 10/1925 | McKissick | 74/108 |
| 1,620,795 | A | * | 3/1927 | Black | 74/108 |
| 1,860,513 | A | * | 5/1932 | Sperry | 74/40 |
| 2,049,315 | A | * | 7/1936 | Patterson | 74/589 |
| 2,256,599 | A | * | 9/1941 | Taylor, Sr. | 74/103 |
| 2,805,580 | A | * | 9/1957 | Kane | 74/108 |
| 2,926,000 | A | * | 2/1960 | Allen | 74/89.22 |
| 3,006,201 | A | * | 10/1961 | Ross | 74/41 |
| 3,029,650 | A | * | 4/1962 | Byrd | 74/41 |
| 3,136,166 | A | * | 6/1964 | Journeay | 74/41 |
| 3,153,387 | A | * | 10/1964 | Sadouet | 92/130 R |
| 3,221,569 | A | * | 12/1965 | Ross | 74/108 |
| 3,248,958 | A | * | 5/1966 | Bender | 74/89.2 |

(Continued)

*Primary Examiner* — Charles Freay
*Assistant Examiner* — Alexander Comley
(74) *Attorney, Agent, or Firm* — Matthias Scholl P.C.; Matthias Scholl

(57) ABSTRACT

A crank-type non-beam pumping unit, including a belt, a foundation, a crown sheave, a frame, a support rod, a belt pulley, a pin shaft, a crank, a transmission shaft, and a bracket. The bottom of the frame is disposed on the foundation, and the top of the frame is supported by the support rod. The top of the support rod is hinge connected to the frame, and the bottom of the support rod is hinge connected to the foundation. The bracket is disposed on the foundation, the transmission shaft is disposed on the bracket, and the crank is disposed on the transmission shaft. The crank rotates synchronously with the transmission shaft, and the belt pulley is disposed on one end of the crank via the pin shaft. One end of the belt bypasses the crown sheave, and is connected to a smooth sucker rod.

2 Claims, 3 Drawing Sheets

(56) References Cited

U.S. PATENT DOCUMENTS

| | | | | | |
|---|---|---|---|---|---|
| 4,052,907 | A | * | 10/1977 | Chardonneau et al. | 74/89.22 |
| 4,197,766 | A | * | 4/1980 | James | 74/89.2 |
| 4,226,404 | A | * | 10/1980 | Zens | 254/359 |
| 4,483,208 | A | * | 11/1984 | Parker, Jr. | 74/41 |
| 4,505,162 | A | * | 3/1985 | Hoh et al. | 74/41 |
| 4,519,262 | A | * | 5/1985 | Le et al. | 74/89.2 |
| 4,586,879 | A | * | 5/1986 | Slater | 417/411 |
| 4,603,592 | A | * | 8/1986 | Siebold et al. | 74/41 |
| 4,686,862 | A | * | 8/1987 | Mair et al. | 74/44 |
| 4,719,811 | A | * | 1/1988 | Lang et al. | 74/89.22 |
| 4,761,120 | A | * | 8/1988 | Mayer et al. | 417/403 |
| 5,281,100 | A | * | 1/1994 | Diederich | 417/18 |
| 5,735,170 | A | * | 4/1998 | Bales et al. | 74/41 |
| 7,390,173 | B2 | * | 6/2008 | Pasquan | 417/529 |
| 7,458,786 | B2 | * | 12/2008 | MacDonald | 417/328 |
| 2006/0024171 | A1 | * | 2/2006 | Smith et al. | 417/199.1 |
| 2006/0024177 | A1 | * | 2/2006 | Robison et al. | 417/390 |
| 2009/0047153 | A1 | * | 2/2009 | Best | 417/415 |

* cited by examiner

OIL PUMPING UNIT

CROSS-REFERENCE TO RELATED APPLICATIONS

Pursuant to 35 U.S.C. §119 and the Paris Convention Treaty, this application claims the benefit of Chinese Patent Application No. 201010226167.1 filed on Jun. 29, 2010, the contents of which are incorporated herein by reference.

BACKGROUND OF THE INVENTION

1. Field of the Invention

The invention relates to a pumping unit, and more particularly to a crank-type non-beam pumping unit.

2. Description of the Related Art

Nowadays pumping units are widely used, and are divided into two types: a beam pumping unit, and a vertical pumping unit. The beam pumping unit features large number of components, complex structure, high production cost, low mechanical efficiency, and poor economy. As for the vertical pumping unit, there are several problems therewith: transportation thereof is inconvenient, and special equipments must be used to move it during workover operation; moreover, this type of pumping unit cannot meet requirement for coordinate installation of multiple pumping units among multiple oil wells.

SUMMARY OF THE INVENTION

In view of the above-described problem, it is an objective of the invention to provide a crank non-beam pumping unit that is capable of addressing the above-mentioned problems.

To achieve the above objectives, in accordance with one embodiment of the invention, provided is a crank non-beam pumping unit, comprising a belt, a foundation, a crown sheave, a frame, a support rod, a belt pulley, a pin shaft, a crank, a transmission shaft, and a bracket, the bottom of the frame is disposed on the foundation, the top of the frame is supported by the support rod, the top of the support rod is hinge connected to the frame, the bottom of the support rod is hinge connected to the foundation, the bracket is disposed on the foundation, the transmission shaft is disposed on the bracket, the crank is disposed on the transmission shaft, the bracket and the crank are symmetric, the crank rotates synchronously with the transmission shaft, the belt pulley is disposed on one end of the crank via the pin shaft, one end of the belt bypasses the crown sheave, and is connected to a smooth sucker rod, and the other end of the belt is wrapped on the belt pulley.

In a class of this embodiment, two or more of the pumping units are serially connected, the crown sheave, the frame, the support rod, the belt, the belt pulley, the pin shaft, the crank, the transmission shaft, the bracket, and the foundation of each of the pumping units is the same, one end of the transmission shaft is connected to a power supply, the other end of the transmission shaft is connected to a crank of a first pumping unit, the other crank of the first pumping unit is connected to an end of a second transmission shaft, the other end of the second transmission shaft is connected to a crank of a second pumping unit, an end of a third transmission shaft is connected to the other crank of the second pumping unit, cranks of the pumping units are staggered mounted, and stagger angles between cranks of each of the pumping unit are the same.

In a class of this embodiment, the other end of the belt bypasses the belt pulley, and is fixed on the foundation.

In a class of this embodiment, a length regulator is disposed on the support rod.

In a class of this embodiment, the bottom of the frame is hinge connected to the foundation.

Advantages of the invention comprise: as a power supply drives the transmission shaft to rotate, the crank synchronously rotates therewith, the belt pulley rotates with respect to the transmission shaft, and a connection terminal between the belt and the smooth sucker rod reciprocally moves up and down, and drives the smooth sucker rod to pump oil; the invention has no beam, and thus structure thereof is simple; multiple pumping units can be connected to the transmission shaft, which makes the invention meet requirement for coordinate installation of multiple pumping units among multiple oil wells, and thus improving mechanical efficiency, and reducing power consumption, and therefore, the invention has significant economic benefit.

DETAILED DESCRIPTION OF THE EMBODIMENTS

Further description of the invention will be given below in conjunction with accompanying drawings.

Figure 1:
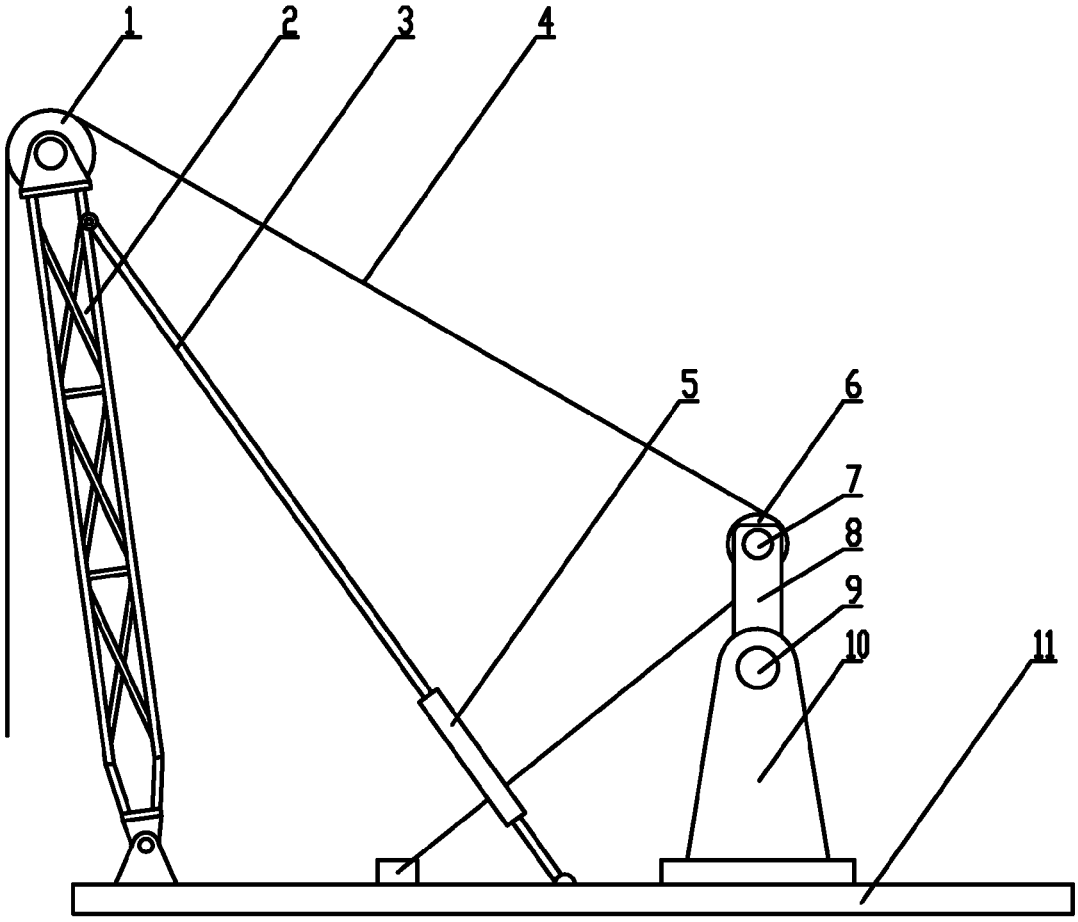
FIG. 1 is a schematic view of a crank non-beam pumping unit of an exemplary embodiment of the invention.

As shown in FIG. 1, a crank non-beam pumping unit of the invention comprises a belt 4, a foundation 11, a crown sheave 1, a frame 2, a support rod 3, a belt pulley 6, a pin shaft 7, a crank 8, a transmission shaft 9, and a bracket 10.

The bottom of the frame 2 is disposed on the foundation 11, and the top of the frame 2 is supported by the support rod 3.

The top of the support rod 3 is hinge connected to the frame 2, and the bottom of the support rod 3 is hinge connected to the foundation 11.

The bracket 10 is disposed on the foundation 11.

The transmission shaft 9 is disposed on the bracket 10, the crank 8 is disposed on the transmission shaft 9, and the bracket 10 and the crank 8 are symmetric.

The crank 8 rotates synchronously with the transmission shaft 9.

The belt pulley 6 is disposed on one end of the crank 8 via the pin shaft 7.

One end of the belt 4 bypasses the crown sheave 1, and is connected to a smooth sucker rod, and the other end of the belt 4 is wrapped on the belt pulley 6.

The other end of the belt 4 bypasses the belt pulley 6, and is fixed on the foundation 11.

A length regulator 5 is disposed on the support rod 3. By adjusting the length regulator 5, the frame 2 leans back and is beyond movement range of a travelling block of a production rig. At this time, workover operation can be done, and no extra equipment is required to move it, and the workover operation is very convenient.

The bottom of the frame 2 is hinge connected to the foundation 11. As the frame 2 leans back by adjustment of the length regulator 5, the frame 2 rotates with respect to a hinge connection point between the bottom thereof and the foundation 11.

The crank non-beam pumping unit of the invention can be used independently, or multiple crank non-beam pumping units can be coordinately used among multiple oil wells, which make the invention especially suitable for cluster wells production.

Figure 2:
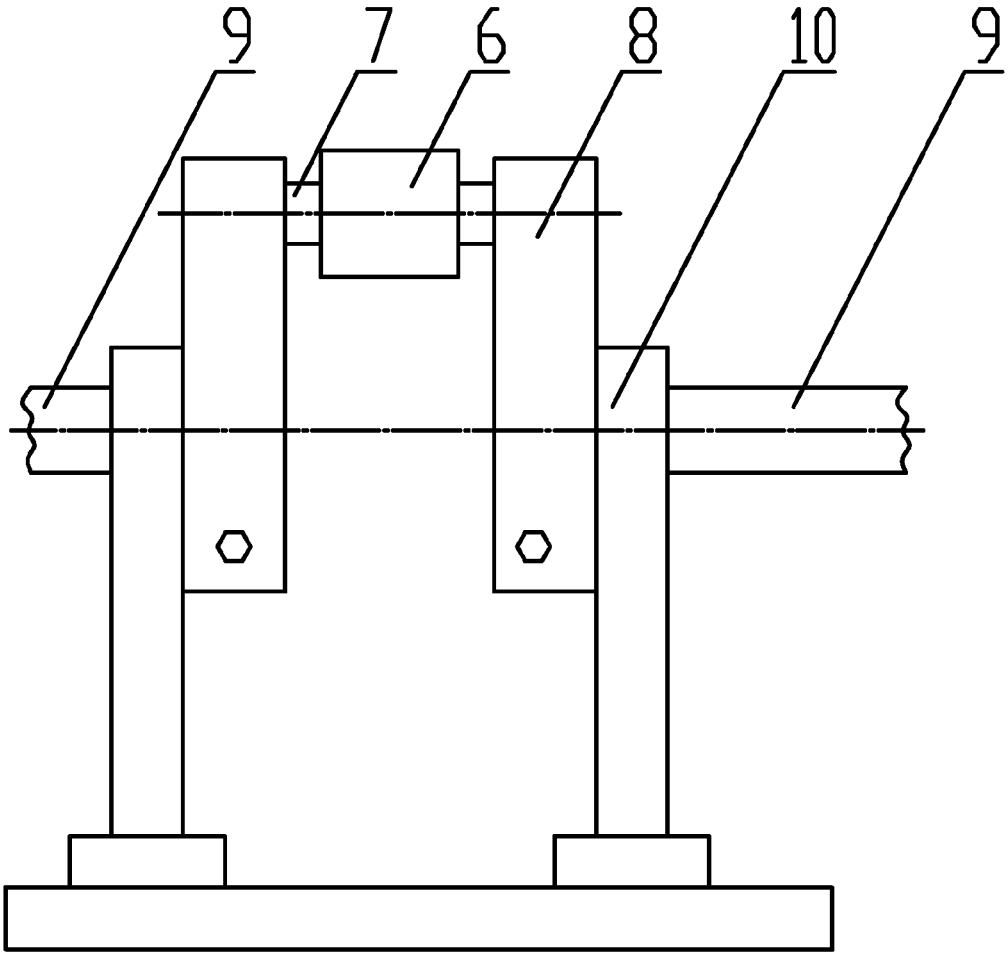
FIG. 2 illustrates installation of a belt pulley, a pin shaft, a crank, a transmission shaft, and a bracket of the invention.
Figure 3:
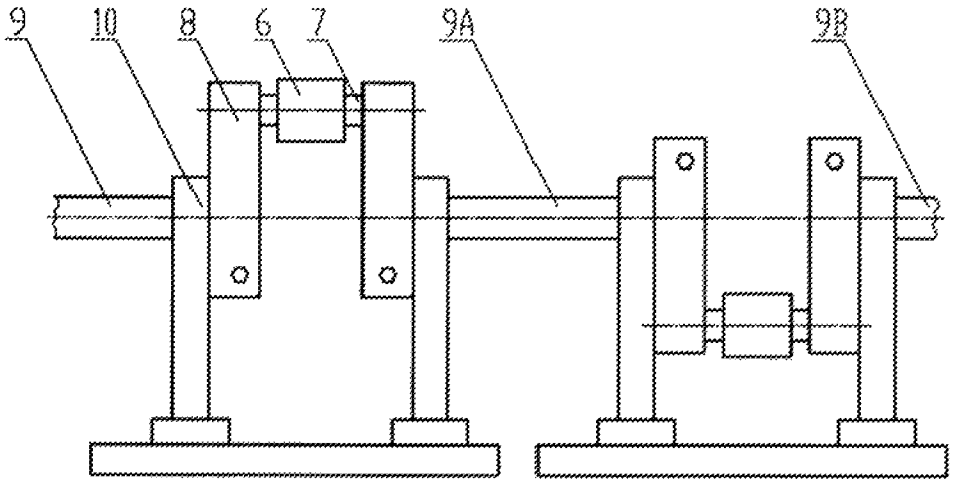
FIG 3 shows a schematic view of two crank non-beam pumping units connected to one another.

As shown in FIG. 2, if multiple crank non-beam pumping units are coordinately used among multiple oil wells, multiple transmission shafts 9 are used. One transmission shaft 9 is connected to a crank 8, another transmission shaft 9 is connected to the other crank 8, a further transmission shaft 9 is connected to a power supply, and operates as a driving shaft, a still further transmission shaft 9 is connected to a crank of another pumping unit, and operates as a driven shaft. Thus, multiple crank non-beam pumping units can be coordinately used among multiple oil wells. Two or more of the pumping units are serially connected, the crown sheave 1, the frame 2, the support rod 3, the belt 4, the belt pulley 6, the pin shaft 7, the crank 8, the transmission shaft 9, the bracket 10, and the foundation 11 of each of the pumping units is the same, one end of the transmission shaft 9 is connected to a power supply, the other end of the transmission shaft 9 is connected to a crank 8 of a first pumping unit, the other crank 8 of the first pumping unit is connected to an end of a second transmission shaft 9A, the other end of the second transmission shaft 9A is connected to a crank 8 of a second pumping unit, an end of a third transmission shaft 9B is connected to the other crank 8 of the second pumping unit, and cranks 8 of the pumping units are staggered mounted. As shown in FIG. 2, a stagger angle between cranks 8 of the pumping units is 180°, and thus alternating loads on uplinks and downlinks are balanced, which improves mechanical efficiency of the oil wells. If three pumping units are connected, the stagger angle is 120°.

An output shaft on a reduction box of the power supply is integrated with the transmission shaft 9.

As the crank non-beam pumping unit of the invention is used independently, and alternating loads are comparatively large, a counterweight can be added on the other end of the crank 8 whereby facilitating balance.

As the crank non-beam pumping unit of the invention is used independently, and alternating loads are comparatively large, a counterweight can be added on the other end of the crank 8 whereby facilitating balance.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An oil pumping unit, comprising:

a belt (4);

a foundation (11);

a crown sheave (1);

a frame (2);

a support rod (3);

a belt pulley (6);

a pin shaft (7);

a crank (8);

a transmission shaft (9); and a bracket (10);

wherein:

a bottom of said frame (2) is disposed on said foundation (11);

a top of said frame (2) is supported by said support rod (3);

a top of said support rod (3) is hinge connected to said frame (2);

a bottom of said support rod (3) is hinge connected to said foundation (11);

said bracket (10) is disposed on said foundation (11);

said transmission shaft (9) is disposed on said bracket (10);

said crank (8) is disposed on said transmission shaft (9);

said bracket (10) and said crank (8) are symmetric;

said crank (8) rotates synchronously with said transmission shaft (9);

said belt pulley (6) is disposed on one end of said crank (8) via said pin shaft (7);

one end of said belt (4) bypasses said crown sheave (1), and is connected to a smooth sucker rod;

an other end of said belt (4) is wrapped on said belt pulley (6);

two or more of said pumping units are serially connected;

said crown sheave (1), said frame (2), said support rod (3), said belt (4), said belt pulley (6), said pin shaft (7), said crank (8), said transmission shaft (9), said bracket (10), and said foundation (11) of each of said pumping units is the same;

one end of said transmission shaft (9) is connected to a power supply;

an other end of said transmission shaft (9) is connected to a crank (8) of a first pumping unit;

an other crank (8) of said first pumping unit is connected to an end of a second transmission shaft (9A);

an other end of said second transmission shaft (9A) is connected to a crank (8) of a second pumping unit;

an end of a third transmission shaft (9B) is connected to the crank (8) of said second pumping unit; and cranks (8) of said pumping units are mounted in a staggered configuration.

2. An oil pumping unit, comprising:

a belt (4);

a foundation (11);

a crown sheave (1);

a frame (2);

a support rod (3);

a belt pulley (6);

a pin shaft (7);

a crank (8);

a transmission shaft (9); and a bracket (10);

wherein:

a bottom of said frame (2) is disposed on said foundation (11);

a top of said frame (2) is supported by said support rod (3);

a top of said support rod (3) is hinge connected to said frame (2);

a bottom of said support rod (3) is hinge connected to said foundation (11);

said bracket (10) is disposed on said foundation (11);

said transmission shaft (9) is disposed on said bracket (10);

said crank (8) is disposed on said transmission shaft (9);

said bracket (10) and said crank (8) are symmetric;

said crank (8) rotates synchronously with said transmission shaft (9);

said belt pulley (6) is disposed on one end of said crank (8) via said pin shaft (7);

one end of said belt (4) bypasses said crown sheave (1), and is connected to a smooth sucker rod;

an other end of said belt (4) is wrapped on said belt pulley (6);

two or more of said pumping units are serially connected;

said crown sheave (1), said frame (2), said support rod (3), said belt (4), said belt pulley (6), said pin shaft (7), said crank (8), said transmission shaft (9), said bracket (10), and said foundation (11) of each of said pumping units is the same;

one end of said transmission shaft (9) is connected to a power supply;

an other end of said transmission shaft (9) is connected to a crank (8) of a first pumping unit;

an other crank (8) of said first pumping unit is connected to an end of a second transmission shaft (9A);

an other end of said second transmission shaft (9A) is connected to a crank (8) of a second pumping unit;

an end of a third transmission shaft (9B) is connected to the crank (8) of said second pumping unit;

cranks (8) of said pumping units are mounted in a staggered configuration;

the other end of said belt (4) bypasses said belt pulley (6) and is fixed on said foundation (11);

a length regulator (5) is disposed on said support rod (3); and the bottom of said frame (2) is hinge connected to said foundation (11).

* * * * *